US007493742B2

(12) United States Patent
Wegner

(10) Patent No.: US 7,493,742 B2
(45) Date of Patent: Feb. 24, 2009

(54) ROTATIONAL CONTROL ASSEMBLY IN PACKAGING MACHINES

(75) Inventor: Paul Edward Wegner, New London, WI (US)

(73) Assignee: Curwood, Inc., Oshkosh, WI (US)

( * ) Notice: Subject to any disclaimer, the term of this patent is extended or adjusted under 35 U.S.C. 154(b) by 63 days.

(21) Appl. No.: 11/732,690

(22) Filed: Apr. 4, 2007

(65) Prior Publication Data

US 2008/0245032 A1 Oct. 9, 2008

(51) Int. Cl.
*B65B 7/28* (2006.01)

(52) U.S. Cl. ..... 53/349; 53/341; 74/567; 74/10.29; 74/526

(58) Field of Classification Search ..... 53/349, 53/341, 351; 74/567, 569, 10.29, 10.6, 813 L, 74/526; 192/12 B, 41 R
See application file for complete search history.

(56) References Cited

U.S. PATENT DOCUMENTS

| | | | | | |
|---|---|---|---|---|---|
| 3,780,486 | A * | 12/1973 | Jensen et al. | ..... | 53/415 |
| 4,244,623 | A * | 1/1981 | Hall et al. | ..... | 297/411.36 |
| 4,282,771 | A * | 8/1981 | Grube | ..... | 74/505 |
| 4,311,060 | A * | 1/1982 | Kawaguchi et al. | ..... | 74/142 |
| 4,354,815 | A * | 10/1982 | Bardsley et al. | ..... | 425/236 |
| 4,444,108 | A * | 4/1984 | Jenness, III | ..... | 101/305 |
| 5,092,102 | A * | 3/1992 | James et al. | ..... | 53/51 |
| 6,357,211 | B1 * | 3/2002 | Flesch | ..... | 53/477 |

* cited by examiner

*Primary Examiner*—Hemant M Desai
(74) *Attorney, Agent, or Firm*—Tom J. Hall

(57) ABSTRACT

The present invention provides an assembly for controlling the rotational movement of a die wheel in packaging machinery and includes a first component operationally interconnected to both the die wheel and camshaft, and a second component physically connected to both the first component and the framework of the packaging machine wherein the second component is detachably mounted to the framework.

9 Claims, 4 Drawing Sheets

ROTATIONAL CONTROL ASSEMBLY IN PACKAGING MACHINES

TECHNICAL FIELD

This invention relates to the field of packaging machinery. Specifically, the present disclosure is a system for controlling the rotational movement of a die wheel in packaging machinery.

BACKGROUND OF THE INVENTION

Packaging machinery for packaging food products such as cheese and meat, particularly, processed meat, such as bacon, are known in the art. In general, packaging machinery which are cam-operated are designed such that the rotating camshaft imparts rotational, horizontal and/or vertical motion to various camshaft components, i.e., cams, gears, sprockets and the like. These camshaft components, in turn, drive the various mechanical operations needed to produce a packaged food product.

One type of cam-operated food packaging machine is a rotary die wheel packaging machine. Rotary die wheel packaging machines are designed to automatically perform multiple packaging operations around a central rotating die wheel. In this machine, package forming/sealing, food loading and package dispensing operations are synchronized with and take place around a central rotating die wheel to make the finished packaged food product. In operation, a first packaging film is loaded into forming/sealing die cavities located on the central rotating die wheel. Each forming/sealing die cavity includes a peripheral edge called a die bead where hermetic seals are formed around the package. After the film is received, a film tucker assembly forces the film under film clamps where film is secured to the die, where it is then heated to a predetermined temperature to soften the film. A vacuum is applied from the backside of the die cavity facing the softened film and the film is thermoformed into the shape of the die cavity. As the die wheel advances, a food item is transferred from a loading station onto a second packaging film. The food item is then carried into the die cavity where it is sandwiched between the first and second packaging films. Next, the outer peripheral edges which extend beyond the food item are joined together during a first heat sealing operation. The seal that is formed extends around the outer peripheral edges of the die cavity or die bead and includes at least one aperture or unsealed area between the first and second packaging films. As the die wheel advances further, a chamber comes in contact with the die where the atmosphere surrounding the food item and between the packaging films is evacuated through the aperture. A second heat sealing operation is then performed to close the aperture and hermetically seal the food item within. Finally, the film between the die cavities is cut and a product picking station removes each individual package from the die wheel.

In general, rotary die wheel packaging machines are designed so that, during normal operation, the die wheel rotates is one direction, i.e., clockwise or counter-clockwise, so that each packaging operation may be synchronized to the forward direction of rotation of the die wheel. However, when power is removed to these machines, particularly after an emergency shut-down, the die wheel may respond by moving for short distances in the opposite direction. This can result in damage to mechanical components and assemblies operationally interconnected to the die wheel. For example, if the die wheel rotates backwards, the film tucker can damage the die beads by scratching or marring the surface of the die bead. A damaged die bead surface will not allow hermetic seals to be formed in the food package and, therefore, adversely affect the quality of the finished package.

BRIEF SUMMARY OF THE INVENTION

It is therefore an object of the present invention to provide an assembly for controlling the rotational movement of a die wheel in packaging machinery thereby preventing damage to other mechanical components and systems operationally interconnected to the die wheel.

It is another object of the present invention to provide an assembly for limiting the counter-rotational displacement of a camshaft thereby preventing damage to other mechanical components and systems operationally interconnected to the die wheel, particularly, the die beads of a rotary die wheel packaging machine.

These and other objects of the present invention are provided by a first component operationally interconnected to both the die wheel and camshaft, and a second component physically connected to both the first component and the framework of the packaging machine wherein the second component is detachably mounted to the framework.

DETAILED DESCRIPTION OF THE INVENTION

Although specific embodiments of the present invention will now be described with reference to the drawings, it should be understood that such embodiments are by way of example only and merely illustrative of but a small number of the many possible specific embodiments which can represent applications of the principles of the present invention.

Figure 1:
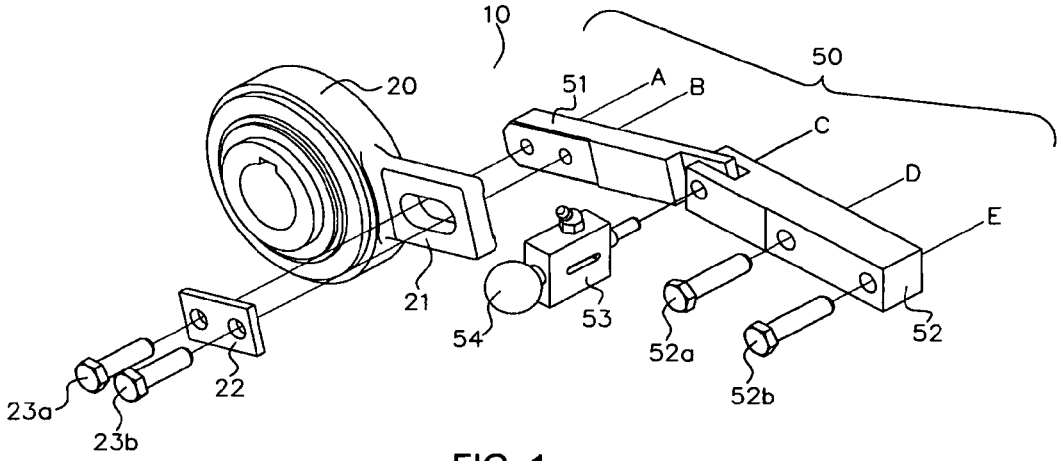
FIG. 1 shows a schematic exploded view of an assembly for controlling the rotational movement of a die wheel in packaging machinery according to the present invention.

Referring now to the drawings, wherein similar characters designate corresponding parts throughout the several views, there is illustrated a preferred embodiment of an assembly for controlling the rotational movement of a die wheel in packaging machinery according to the present invention. Referring specifically to FIG. 1, there is illustrated schematically an exploded view of assembly 10 comprising a first component 20 and a second component 50. In this embodiment, first component 20 may further comprise an attachment member 21 for joining first component 20 to second component 50. It is within the scope of the present invention that first component 20 may be any mechanical mechanism or device which when used in combination with second component 50, being secured to framework 60 (FIG. 3), will respond to and control the counter-rotational movement of a die wheel 40 (see FIG. 4) in rotary die wheel packaging machines. As such, first component 20 may be any mechanical braking mechanism or device which may include, but is not limited to, mechanical clutches, ratchets, one-way bearings and the like.

Second component 50 may include one or more members. In this embodiment, second component 50 includes a first linkage arm 51 and a second linkage arm 52 and is coupled to first component 20 by bolting a first end of the first linkage arm 51 to attachment arm 21 with rectangular washer 22 and bolts 23*a* and 23*b* along lines A and B. As shown, a second end of first linkage arm 51 is removably and pivotally joined to one end of second linkage arm 52 along line C with fastening means 53 in a clevis-like arrangement. Second linkage arm 52 is secured directly to framework 60 (FIG. 3) or, alternatively, may be secured to framework mounting plate 55 (FIG. 2) by bolts 52*a* and 52*b* along lines D and E as shown in this diagram.

Figure 2:
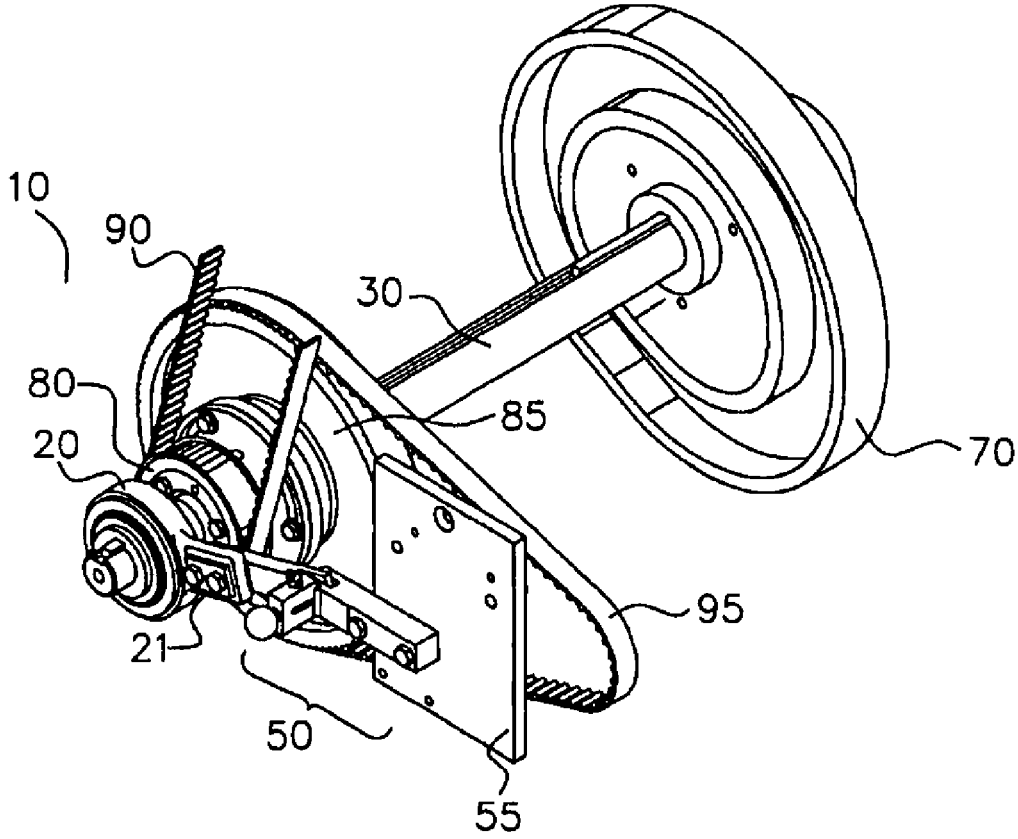
FIG. 2 shows a schematic partial view of one preferred embodiment of an assembly mounted to a camshaft for controlling the rotational movement of a die wheel in packaging machinery according to the present invention.

In addition to serving as a means for removably securing first linkage arm 51 to second linkage arm 52, fastening means 53 may also provide a means for disconnecting first linkage arm 51 from framework, 60. As such, means 53 may comprise a pin attachment mechanism, 54, which provides a means for manually disconnecting first linkage arm 51 from framework 60 (FIG. 3) when second linkage arm is secured directly to framework 60 (FIG. 3) or framework mounting plate 55 (FIG. 2). The pin attachment mechanism 54 may be permanently adhered to second linkage arm 52 such that first linkage arm 51 can be removed from second linkage arm 52 by disengaging a pin in pin attachment mechanism, 54.

Referring now to FIG. 2, there is illustrated an example of assembly 10 with first component 20 mounted to camshaft 30. In this example, second component 50 may be mechanically secured to framework 60 (FIG. 3) by means of a framework mounting plate 55, shown here, being connected to second linkage arm 52. Also depicted are cam 70, sprockets 80 and 85, all of which are mounted to camshaft 30 and operationally interconnect camshaft 30 to die wheel 40 (see FIG. 4). Around sprocket 80 is belt 90 which provides a driving mechanism to die wheel 40 (FIG. 4) and other mechanical systems of the packaging machine. Camshaft 30 is powered by motor 210 (see FIG. 4) which may be interconnected to belt 95 and sprocket 85.

In general, at least one or more cams mounted to the camshaft in die wheel packaging machines will have a non-symmetrical or irregular contour (not shown). A cam follower (not shown) will be in contact with and positioned on the cam. In operation, the cam follower engages with the leading edge of the cam contour and translates the rotary motion of the cam into oscillating horizontal and/or vertical motion. As the cam rotates with the camshaft, other machine components and systems mechanically connected to the cam follower are actuated. When power is withdrawn from the camshaft, the cam follower may continue to move in response to its relative position on the cam profile. This movement of the cam follower may, in turn, cause the die wheel to move. Movement of the die wheel may be in a clockwise or counter-clockwise direction. It will be understood that the term "counter-rotational" refers to the relative movement of the die wheel and camshaft in a direction opposite to that of normal operation.

Accordingly, assembly 10 of the present invention may control the counter-rotation of the die wheel in either a clockwise or counter-clockwise direction so that the counter-rotational displacement of camshaft 30 is 10 degrees or less relative to the axis of rotation of camshaft 30. Assembly 10 of the present invention may further control the counter-rotational movement of the die wheel in either a clockwise or counter-clockwise direction such that the counter-rotational displacement of camshaft 30 is 5 degrees or less relative to the axis of rotation of camshaft 30. Assembly 10 of the present invention may still further control the counter-rotational movement of the die wheel in either a clockwise or counter-clockwise direction such that the counter-rotational displacement of camshaft 30 is 2 degrees or less relative to the axis of rotation of camshaft 30. It is also within the scope of the present invention that assembly 10 may be used to manually rotate camshaft 30 in either a clockwise or counter-clockwise direction when second component 50 or a portion thereof, is disconnected from framework 60 (FIG. 3) or framework mounting plate 55. With reference to FIGS. 1 and 2, the manual rotation of camshaft 30 may be accomplished when first linkage arm 51 is connected to attachment 21 and first linkage arm 51 is disconnected from the second linkage arm 52 by removing fastening means 53 therefrom. Those skilled in the art will recognize that the ability to manually rotate camshaft 30 in either a clockwise or counter-clockwise direction provides a means for manually adjusting the timing of one or more mechanical operations interconnected to camshaft 30 by a machine operator.

Figure 3:
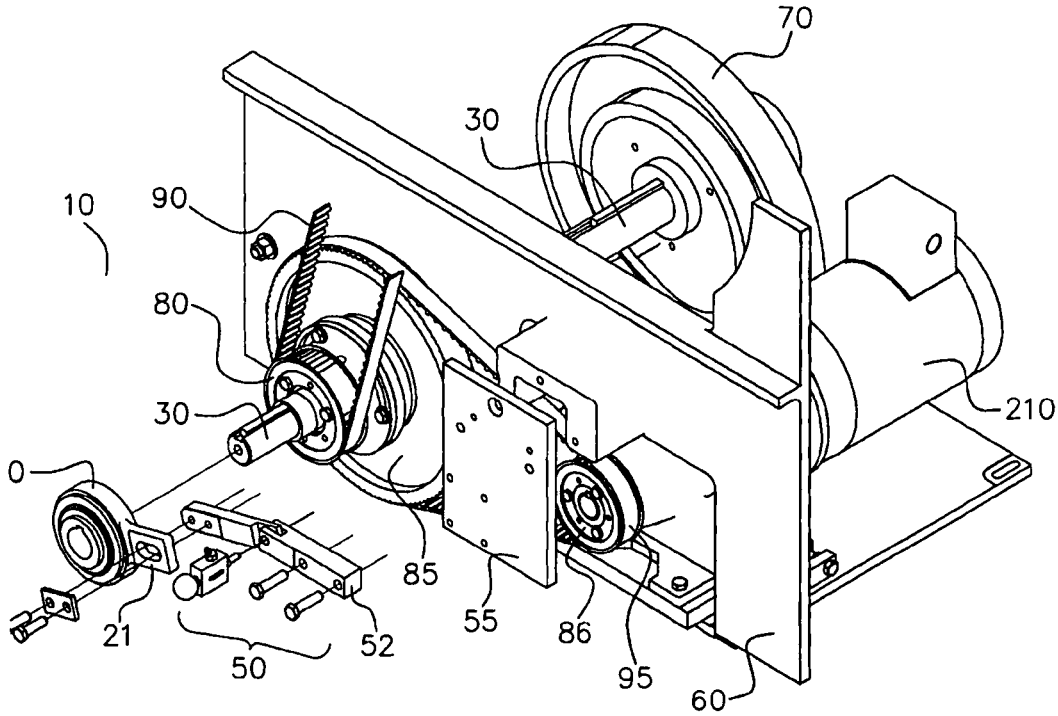
FIG. 3 shows another schematic exploded view of one preferred embodiment of an assembly mounted to a camshaft for controlling the rotational movement of a die wheel in packaging machinery according to the present invention.

Turning now to FIG. 3, another exploded view of assembly 10 is shown. As depicted in this drawing, motor 210 drives camshaft 30 by means of sprockets 85 and 86 and belt 95. Transferring the motion of camshaft 30 to die wheel 40 (FIG. 4) are sprocket 80 and belt 90. As shown, framework mounting plate 55 is used to secure second component 50 of assembly 10 to framework 60.

It is important to note that while this preferred embodiment shows first component 20 mounted to camshaft 30, it is within the scope of the present invention that first component 20 may be directly mounted to and actuated by die wheel 40 (see FIG. 4) or, alternatively, by other machine components operationally connected to the die wheel.

Figure 4:
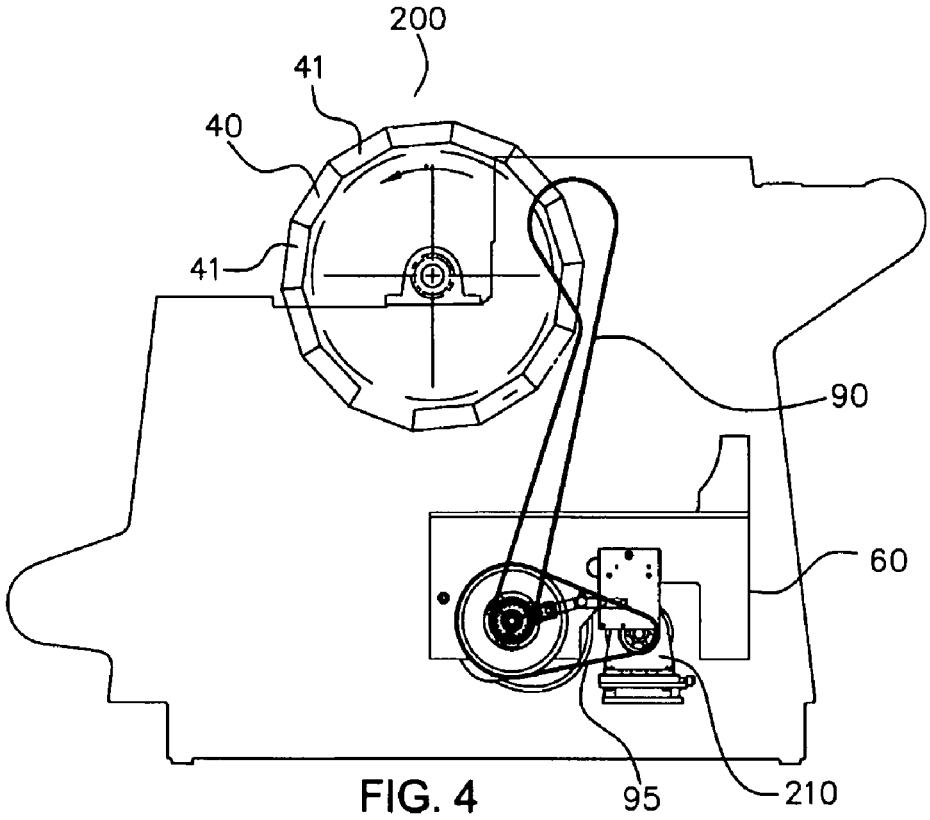
FIG. 4 shows a partial cross-sectional schematic of a rotary die wheel packaging machinery according to the present invention.

In FIG. 4, there is illustrated a partial side view of one example of a rotary die wheel packaging machine 200. The rotary die wheel 40 is shown having a plurality of forming/sealing die cavities 41, each of which is positioned around the circumference of die wheel 40. Each forming/sealing die cavity 41 includes a sealing area (not shown) referred to as a die bead which is generally a flat smooth surface. Forming/sealing die cavities 41 rotate with die wheel 40 in a counter-clockwise direction as indicated by the arrow. In this example, camshaft 30 (see FIG. 2 and 3) is driven by motor 210 by belt 95 which, in turn, transfers the motion of camshaft 30 to die wheel 40 by belt 90. It will be appreciated by those skilled in the art that a variety of other linkage mechanisms known in the art can be employed to transfer motion imparted by camshaft 30 to die wheel 40.

It will be apparent to those skilled in the art that modifications and additions can be made to the various embodiments described above, without departing from the true scope and spirit of the present invention. It should be understood that this invention is not intended to be unduly limited by the illustrative embodiments set forth herein and that such embodiments are presented by way of example only with the scope of the invention intended to be limited only by the claims set forth herein as follows.

What is claimed is:

1. An assembly for controlling the counter-rotational direction of a die wheel in packaging machinery having a camshaft, said assembly comprising:

a) a first component operationally interconnected to both said die wheel and camshaft, wherein said first component is mounted on said camshaft;

b) a second component physically connecting said first component to the framework of said machinery, wherein said second component is detachably mounted to said framework; and c) means for connecting and disconnecting said second component with said framework such that when said second component is connected with said framework said assembly limits the counter-rotational displacement of said camshaft to a value of 10 degrees or less relative to the axis of rotation of said camshaft; and when said second component is disconnected with said framework, said assembly permits to rotate said camshaft in a direction of normal operation.

2. The assembly according to claim 1, wherein said first component is a clutch.

3. The assembly according to claim 1, wherein said first component is a ratchet.

4. The assembly according to claim 1, wherein said first component is a one-way bearing.

5. The assembly according to claim 1, wherein said first component further comprises an attachment arm for joining to said second component.

6. The assembly according to claim 1, wherein said assembly is operationally connected to a die wheel.

7. The assembly according to claim 1, wherein said assembly limits the counter-rotational displacement of said cam to 5 degrees or less relative to the axis of rotation of said camshaft.

8. The assembly according to claim 1, wherein said assembly limits the counter-rotational displacement of said cam to 2 degrees or less relative to the axis of rotation of said camshaft.

9. The assembly according to claim 1, wherein said second component comprises a means for manually disconnecting said second component from said framework.

* * * * *

UNITED STATES PATENT AND TRADEMARK OFFICE

CERTIFICATE OF CORRECTION

PATENT NO. : 7,493,742 B2
APPLICATION NO. : 11/732690
DATED : February 24, 2009
INVENTOR(S) : Paul Edward Wegner It is certified that error appears in the above-identified patent and that said Letters Patent is hereby corrected as shown below:

FIG. 3, "0" should read --20--.
Column 3, line 25, "52." Should read --52 (FIG.1).--.

Signed and Sealed this

Twenty-ninth Day of September, 2009

David J. Kappos

David J. Kappos
*Director of the United States Patent and Trademark Office*